US006182574B1

(12) United States Patent
Giannoni

(10) Patent No.: US 6,182,574 B1
(45) Date of Patent: Feb. 6, 2001

(54) BULLET

(76) Inventor: Gregory J. Giannoni, 1816 Stoney Crest Dr., Elberton, GA (US) 30635

( * ) Notice: Under 35 U.S.C. 154(b), the term of this patent shall be extended for 0 days.

(21) Appl. No.: 09/313,503

(22) Filed: May 17, 1999

(51) Int. Cl.[7] ..... F42B 12/06
(52) U.S. Cl. ..... 102/516; 102/510; 102/518
(58) Field of Search ..... 120/501, 507–511, 120/514–519; 420/430; 75/248

(56) References Cited

U.S. PATENT DOCUMENTS

| | | | | |
|---|---|---|---|---|
| 740,914 | * | 10/1903 | Platz | 102/519 |
| 1,094,395 | | 4/1914 | Van Kampen et al. | 102/516 |
| 1,155,901 | * | 10/1915 | Duncan | 102/508 |
| 1,202,162 | * | 10/1916 | Clay | 102/518 |
| 1,322,662 | * | 11/1919 | Watson | 102/510 |
| 1,468,113 | | 9/1923 | Johnsen | 102/516 |
| 1,833,645 | * | 11/1931 | Hartz | 102/508 |
| 2,792,618 | * | 5/1957 | Walker | 102/514 |
| 2,928,348 | * | 3/1960 | Zisman et al. | 102/511 |
| 3,720,170 | * | 3/1973 | Godfrey | 102/516 |
| 4,638,738 | * | 1/1987 | Bisping et al. | 102/517 |
| 5,069,869 | * | 12/1991 | Nicolas et al. | 102/517 |
| 5,097,768 | * | 3/1992 | Petrovich | 102/510 |
| 5,185,495 | | 2/1993 | Petrovich et al. | 102/510 |
| 5,279,787 | * | 1/1994 | Oltrogge | 419/38 |
| 5,349,907 | | 9/1994 | Petrovich et al. | 102/506 |
| 5,357,866 | * | 10/1994 | Schluckebier et al. | 102/514 |
| 5,399,187 | | 3/1995 | Mravic et al. | 75/228 |
| 5,528,989 | | 6/1996 | Briese | 102/506 |
| 5,641,937 | | 6/1997 | Carter | 102/507 |
| 5,760,331 | * | 6/1998 | Lowden et al. | 102/506 |

FOREIGN PATENT DOCUMENTS

| | | | | |
|---|---|---|---|---|
| 819445 | * | 8/1969 | (CA) | 102/517 |
| 360312 | * | 3/1962 | (CH) | 102/517 |
| 437544 | * | 4/1912 | (FR) | 102/514 |
| 15707 | * | 8/1904 | (GB) | 102/514 |

* cited by examiner

*Primary Examiner*—Harold J. Tudor
(74) *Attorney, Agent, or Firm*—Flint & Kim, P.A.

(57) ABSTRACT

A projectile designed to be fired from firearms. The projectile has a generally conically shaped jacket having a forward tip, rear base, a body portion, and a central axis. The jacket is formed of a first metal. Located inside the jacket is a generally conically shaped penetrant which is formed of a second metal. The penetrant is formed with a forward tip, a rear base, a body portion, and a central axis. The tip of the penetrant is positioned substantially adjacent the tip of the jacket with their longitudinal axis being aligned. Finally, a core, which is formed of a third metal, fills the jacket and is located about the tip, body, and base of the penetrant. The third metal has a hardness less than that of the first and second metals while the second metal has a hardness greater than that of the first metal. This arrangement causes the projectile to disintegrate upon striking a target with the penetrant breaking through the jacket and the core causing them to expand and decelerate while the penetrant retains its shape and continues to pass through the target. The rear portion of the jacket body includes a shoulder defining an enlarged radial portion which extends along said body to the base. This enlarged radial portion comprises that area of the casing engaged by barrel rifling when the projectile passes through the barrel. The shoulder is located to generally be aligned with the base of the penetrant.

9 Claims, 2 Drawing Sheets

BULLET

BACKGROUND OF THE INVENTION

The instant invention is directed to a projectile for rifles, pistols, and shotgun slugs. The projectile is designed to provide maximum penetration, shock, and accuracy while being used with standard powder loads and barrel rifling.

Multi-component projectiles have been known for many years. U.S. Pat. Nos. 1,094,395; 1,468,113; 5,097,768; and 5,349,907 all disclose multi-component projectiles. None, however disclose a projectile with specific components shaped weighted and located as herein described.

It is a primary object of the instant invention to provide a projectile constructed to include an outer jacket which expands upon striking a target and a penetrant of a heavy dense material which does not expand on contact but continues into the target.

Another object of the invention is to provide increased flight stability by locating the penetrant in the tip of the projectile.

Another object of the invention is to provide specific metal alloys for forming the various components of the projectile with selected specific gravities and harnesses.

Another object of the invention is to provide reduced friction between the barrel rifling and the outer surface of the projectile.

Another object of the invention is to provide a projectile with a duel diameter jacket.

Another object of the invention is to provide a projectile with reduced barrel drag.

Another object of the invention is to provide a projectile in which a majority of the weight is in its tip rather than its base.

Another object of the invention is to construct a projectile of metal alloys of sufficient weight to allow it to have a trajectory which is substantially flat.

Another object of the invention is to construct a projectile of metal alloy of sufficient weight as to allow the projectile to be compact.

SUMMARY OF THE INVENTION

The instant invention is directed to a projectile for use with firearms. The projectile has a generally conically shaped jacket having a forward tip, a rear base, a body portion, and a central axis. The jacket is formed of a first metal. Located inside the jacket is a generally cylindrically shaped penetrant which is formed of a second metal. The penetrant is formed with a forward tip, a rear base, a body portion, and a central axis. The tip of the penetrant is positioned substantially adjacent the tip of the jacket with its longitudinal axis aligned with that of the jacket. Finally, a core, which is formed of a third metal fills the jacket and is located about the tip, body, and base of the penetrant.

The third metal has a hardness less than that of the first and second metals while the second metal has a hardness greater than that of the first metal. This arrangement causes the projectile to disintegrate upon striking a target with the penetrant breaking through the jacket and the core causing them to expand and decelerate while the penetrant retains its shape and continues to pass through the target.

The rear portion of the jacket body includes a shoulder defining an enlarged radial portion which extends along said body to the base. This enlarged radial portion comprises that area of the casing engaged by barrel rifling when the projectile passes through the barrel. The shoulder is located to generally be aligned with the base of the penetrant.

The base of the jacket may be flat as it may be in the shape of a rebated boat tail. The tip of the jacket may be substantially flat or pointed while the projectile tip is preferably pointed. The core adjacent said jacket tip may be cupped in the direction of the projectile tip or it may fill the jacket tip.

The projectile may include an inner jacket between the jacket base and the projectile base. The inner jacket is formed of a metal with a hardness greater than the hardness of the core. The inner jacket is filled with the third metal. The thickness of the jacket wall may increase from the jacket tip to the jacket base. Also, the jacket may include longitudinally extending circumferentially arranged slits which extend from its tip toward its base.

The jacket forming material includes pure copper or copper mixed with 5% to 15% zinc. The core forming material includes an alloy of lead or a tungsten and bismuth alloy while the penetrant metal includes an alloy formed of tungsten and one of bismuth, copper, and tin. A molybdenum disulfide or other suitable plastic coating having a low coefficient of friction may be applied to the outside of the jacket.

A projectile for use with firearms having first and second cores formed of a plurality of metals of differing weights and hardnesses. The second core includes a body having a shaped base and a crater shaped hollowed front portion. The body part is formed of an alloy formed of tungsten combined with bismuth, tin, and copper.

The forward or first core of the projectile is formed of an alloy formed of tungsten and bismuth or tungsten and tin. This alloy is preferably heavier than lead but is softer than the alloy forming the second core. The first core has a specific gravity which is at least equal to that of the second core.

The first core is substantially oval shaped, filling the cavity of the second core with its rear portion while its forward portion forms conically shaped tip.

A shaped copper or copper zinc jacket encases the first and second cores.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
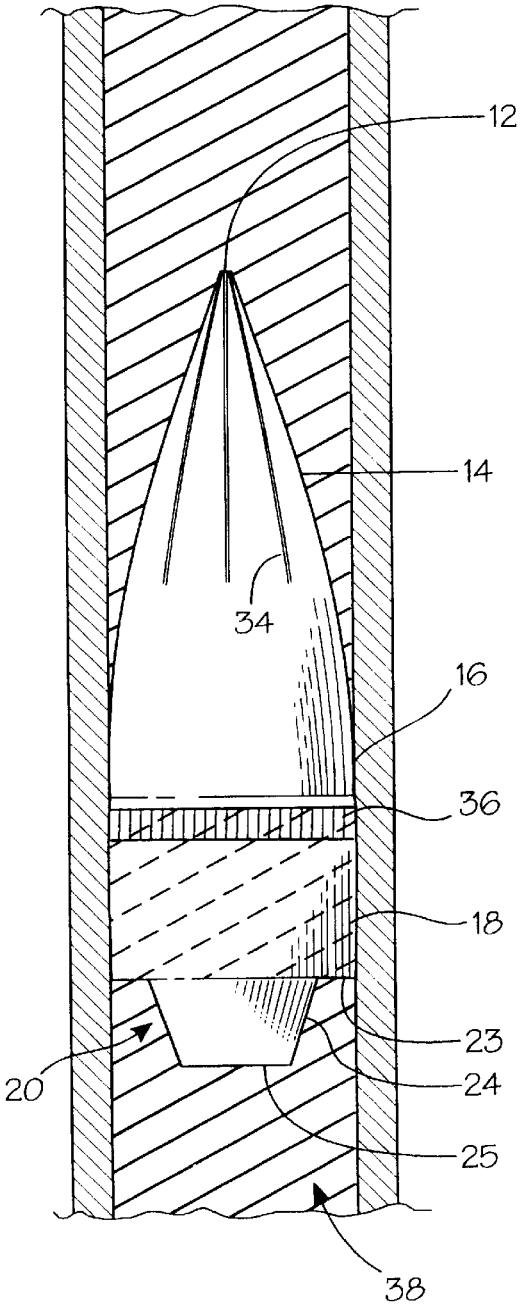
FIG. 1 is a cut-away side view of the projectile of the invention passing through a barrel.
Figure 2A:
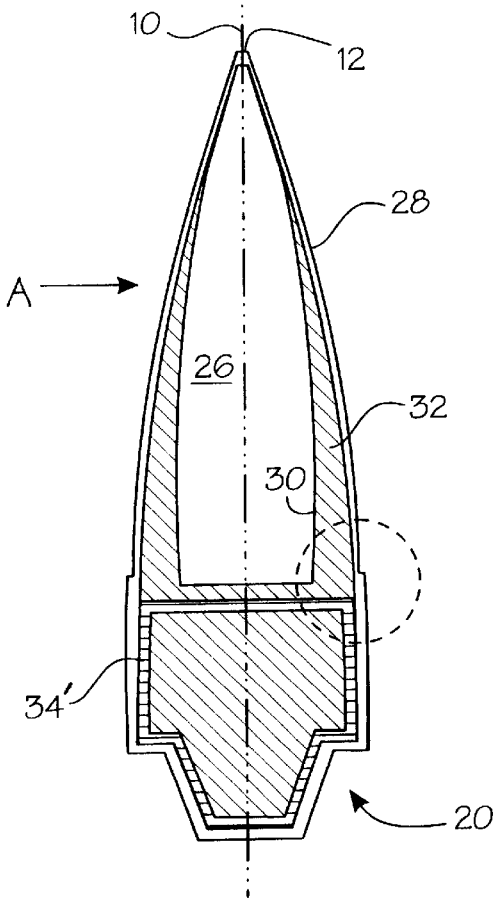
FIG. 2*a* is a cut-away side view of a first aspect of the invention.
Figure 2B:
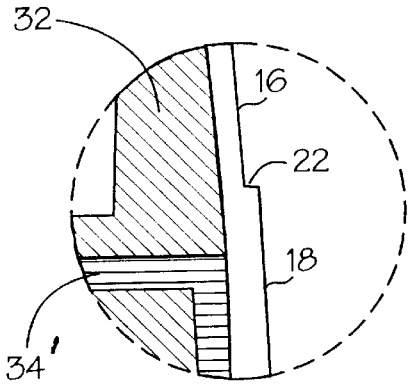
FIG. 2*b* is a exploded view of a section of FIG. 2*a;*

Turning now to FIGS. 1, 2*a* and 2*b*, a first arrangement for the projectile of the invention is shown. The projectile is formed to extend radially along a central axis 10 with a forward tip 12 which is formed substantially as a point, a generally conically shaped forward portion 14, a generally cylindrical first true diameter portion 16, and a generally cylindrical second true diameter portion 18 forming a body portion and a rear base 20. The conically shaped forward portion gradually merges into the forward edge of first portion 16 while the first portion terminates at shoulder 22 which forms the forward end of second portion 18. Second portion 18, which has a diameter slightly larger than the diameter of the barrel opening, is the only portion of the projectile which is scored by the barrel rifling as it passes therethrough.

The base of the projectile is shaped with a rebated boat tail which includes a recessed shoulder 23 and a slightly angled rear extending portion 24 which terminates at rear wall 25. It is noted that the length of forward portion 14 is substantially equal to ½ the length of the projectile.

The components forming the projectile, as best seen in FIGS. 2*a* and 2*b*, include a penetrant 26 formed of an alloy including primarily tungsten and lesser portions of either bismuth, tin, or copper. More specifically the penetrant forming alloy is formed from powdered metal compressed into a solid.

For example, the alloy forming penetrant 26 may comprise by volume between 25% to 75% tungsten with one of the above metals forming the remainder of the alloy or the secondary materials may comprise substantially equal parts of copper and tin or equal parts of copper, tin, and bismuth or equal parts of, copper, and bismuth.

Penetrant 26 is shaped substantially to conform with the shape of projectile A.

Copper jacket 28 forms the outer cover of the projectile. Jacket 28 includes a pointed tip 12, a thin forward shell extending over the conically shaped forward portion 14, and an expanded shell over the first and second true diameter portions 14, 16 and through base portion 20. The thickness of the jacket ranges from about 0.002" through its forward area gradually increasing to about 0.025" to 0.045" over the true diameter and base portions.

Penetrant 26 is designed to rest against the inner side of jacket 28 at its tip with its longitudinal axis aligned with central axis 10. At its area of true diameter 30, penetrant 26 is spaced from the inner wall of jacket 28 by about 0.005" to 0.090". The base of projectile 26 is substantially aligned with or slightly rearwardly of shoulder 22.

The interior area of the jacket is filled with a heavy relatively soft metal core 32 such as lead or alternatively an alloy of tungsten and bismuth and tin and copper or tungsten and bismuth and tin or tungsten and bismuth and copper. Core 32 is sufficiently heavy to provide the proper weight for flight stability and yet is sufficiently soft to expand upon contact with the target. Core 32 substantially covers penetrant 26, covering its entire surface from just beneath its tip. If desired, core 32 could cover the entire penetrant.

If desired, an inner jacket 34' may be provided at a point which substantially separates first true diameter section 16 from second true diameter section 18. Inner jacket 34' consists of a separating plate and reinforcing walls. The interior of the inner jacket is filled with lead or the above described alloy. The jacket provides stability for the rear section on contact with the target. Inner jacket 34' may also be formed of a suitable plastic.

It is important to note that specific gravity of the alloy forming penetrant 26 is greater than that of lead and is always at least equal to that of the alloy forming core 32.

Jacket 28 may have a plurality of longitudinal serrations or slits 34 extending from tip 12 through a majority of the length of conical portion 14. Slits 34 weaken the jacket at its forward end allowing penetrant 26 to exit with greater ease and also causing more even expansion of the jacket and core metal.

A concave cannular 36 may be provided behind shoulder 22 if desired. Cannulars assist in securing projectiles with the bullet casing.

In use, projectile A is fired into the gun barrel where the barrel lands 38 engage with second true diameter portion 18 cutting grooves therein and causing the projectile to rotate. Because portion 18 is spaced from tip 12 projectile A has ample time to obtain maximum velocity before frictionally engaging with the lands. Because of the short length of section 18, friction is held to a minimum. Because the diameter of first section 16 is substantially equal to that of the barrel, first section 16 serves merely to stabilize projectile A during its flight through the barrel-and is not scored by the lands. This particular projectile is normally adopted for use with rifles.

Figure 3:
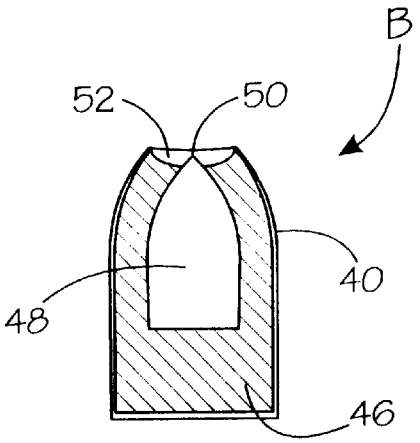
FIG. 3 is a cut-away side view of a second aspect of the projectile of the invention.
Figure 4:
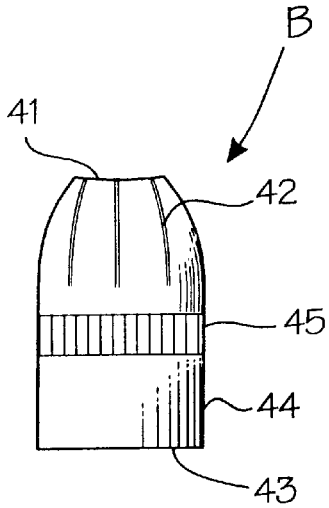
FIG. 4 is a side view of the projectile of FIG. 3.

In a second arrangement shown in FIGS. 3 and 4, a much shorter projectile B is shown. This projectile is normally adopted for use with pistols.

Projectile B includes a jacket 40 usually formed of copper. Jacket 40 is formed with a flat open tip 41, a generally conically shaped forward portion in which slits or serrations 42 are formed, a generally cylindrical body portion 44 of true diameter and a base 43. A cannular 45 may be formed about body portion 44.

The interior of jacket 40 is filled with an alloy or lead core 46. A penetrant 48 is located in the forward portion of projectile B with its tip 50 being substantially aligned with the tip 41. A concave channel 52 is formed in the core 46 between penetrant tip 50, and jacket tip 41 both penetrant tip 50 and jacket tip 41 are above the outer cup shaped surface area 52 of core 46 as clearly shown in FIG. 3.

Again, jacket 40 may be formed of copper or a copper based alloy. Penetrant 48 is preferably formed of an alloy of tungsten and tin, copper, and/or bismuth with tungsten always comprising between 25% and 75% by volume. Core 46 is formed of lead or the alloy as described for core 32.

Jacket 40 along with core 46 of projectile B expand and release penetrant 48 with less contact force than would jacket 28 with a closed tip.

Again, the specific gravity of the alloy forming the penetrant is always greater than or equal to that of the material forming core 46.

Figure 5:
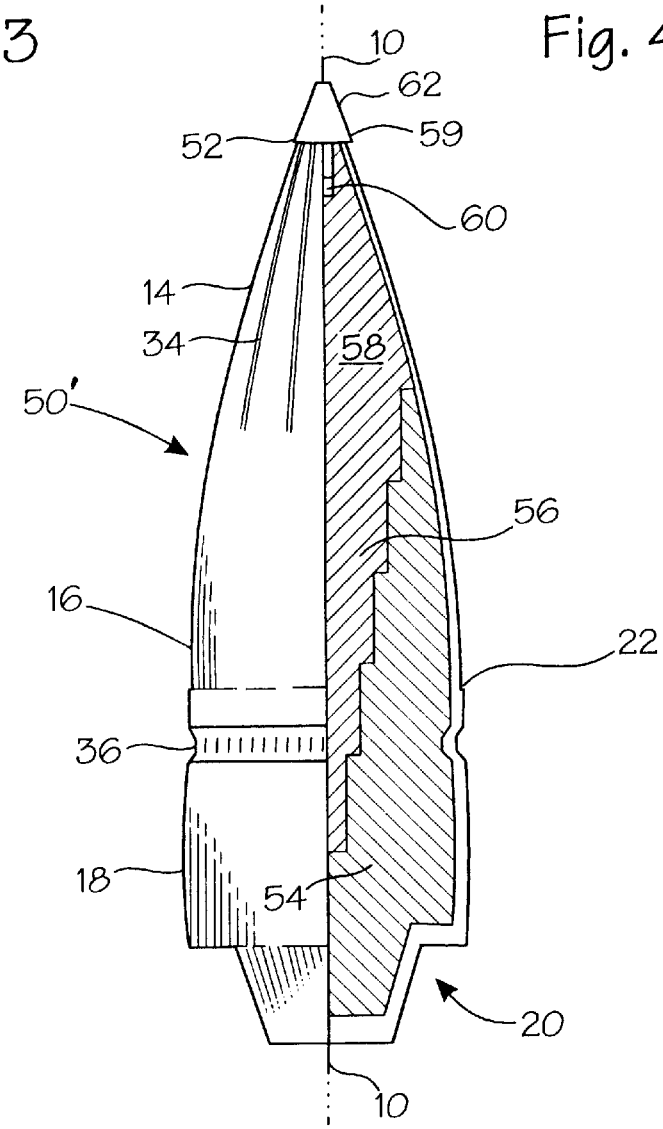
FIG. 5 is a cut-away side view of a third aspect of the projectile of the invention.

FIG. 5 is directed to a third aspect of the projectile of the invention. Projectile C includes a jacket 50' constructed generally as jacket 28 of projectile A. Jacket 50' is formed of tapered copper which is extremely thin, about 0.002" thick, at its forward end and is tapered toward its rear to be about 0.035" to 0.050" at its rear. The jacket includes dual true diameter areas 16, 18, a cannular 36 and a rebated boat tail base 20. A flat tip 52 expands into a forward conical portion 14 with serrations or slits which extend downwardly from tip 52 similar to slits 34 of the jacket of projectile A. Second core component 54 fills jacket 50' from approximately the lower end of slits 34 to base 20. Second core component 54 is formed with a conically shaped cavity 56 which extends from its upper end to about midway of true diameter section 18. The inner walls of cavity 56 may be smoothly tapered or they may be stepped as shown in the drawing. First core component 58 is generally oval shaped with its rear portion mated with the inner wall of cavity 56 and its forward portion being tapered toward tip 59 and sized to mate with the inner wall of jacket 14. Tip 59 is flush with tip 52 of jacket 14. Hole 60 is formed along axis 10. A tipped spike 62 is pressure fitted in hole 16. Spike 62 is umbrella shaped with a pointed tip. It functions to protect tips 52 and 59 and to assist with the ballistic coefficient of the projectile. Spike 62 is formed of copper, nylon or plastic.

Second core 54 is formed of an alloy consisting of about 25% to 75% tungsten and at least one of tin and copper. The percents relate to volume. Core 54 is formed of powdered metals compressed into the described shape and hardened. Core 54 is heavier than lead and is preferably formed to be harder than lead. However, the weight and hardness may vary depending on intended use.

First core 58 is formed of an alloy comprising about 25% to 75% tungsten and at least one of bismuth and tin. Again, the percents relate to volume. This alloy is much softer than the alloy forming core 54 which allows it to expand on impact with a target. The alloy forming core 58 is also preferably formed of powdered metals compressed into a unitary member in known manner.

The alloys forming cores 54 and 58 are formulated to have approximately equal specific gravities although the specific gravity of core 58 could be slightly more than that of core 54.

In use, projectile C, because of the increased specific gravity of cores 54, 58, has sufficient weight for a flat trajectory with minimum wind drift. Because forward core 58 is formed of a relatively soft alloy, it will expand upon contact with the target. Core 54 being formed of an alloy which is relatively hard will retain its shape and act as a penetrant driving through the target. It is noted that the thickened walls of jacket 14 encasing core 54 assist in retaining its shape upon contact with the target.

It should be noted that it is not always necessary to provide a jacket for the core metals. This is particularly true when the projectile is intended for use as a shotgun slug.

It should be noted that the exact weight and length of the projectile is determined by the type of gun it is intended for use with and that use.

While a preferred embodiment of the invention has been described using specific terms, such description is for illustrative purposes only, and it is to be understood that changes and variations may be made without departing from the spirit or scope of the following claims.

What is claimed is:

1. A projectile for being fired from firearms comprising:

a generally cylindrical shaped jacket formed of a first metal of a first hardness, said jacket having a generally conical front end, an open flat tip, a base, a body portion, an interior, and a central axis;

a generally cylindrical shaped penetrant formed of a second metal having a second hardness greater than said first hardness, said penetrant having a generally conical tip, a base, a body, and a central axis, said penetrant being located within said interior of said jacket with said tip being positioned substantially in alignment with said open flat tip with said central axis of said jacket and said penetrant aligned;

a core formed of a third metal having a hardness less than said first hardness and said second hardness, said core filling said jacket interior to a point below said tip of said penetrant and said open flat tip forming a generally cup-shaped exposed exterior, said core being located about said body, and beneath said base of said penetrant; whereby, upon striking a target said projectile easily expands said jacket and said core adjacent said open flat tip, said penetrant breaking out of said jacket to pass through said target while said core and jacket expand and remain in said target.

2. The projectile of claim 1 wherein said second metal comprises an alloy of between 25% and 75% powdered tungsten and between 25% and 75% powdered bismuth compressed into a solid.

3. The projectile of claim 1 wherein said second and third metals each have a specific gravity with the specific gravity of said second metal being greater than the specific gravity of said third metal.

4. The projectile of claim 1 wherein said second metal comprises an alloy formed primarily of powdered tungsten combined with at least one of powdered tin, copper and bismuth and compressed into a solid.

5. The projectile of claim 1 wherein said jacket increases in thickness from said open flat tip toward said base.

6. The projectile of claim 1 wherein said jacket includes longitudinally extending circumferentially arranged slits which extend from said open flat tip toward said base.

7. The projectile fo claim 1 wherein said third metal comprises a mixture tungsten and bismuth.

8. The projectile of claim 1 wherein said first, second, and third metals comprise no lead.

9. A lead-free projectile for being fired from firearms comprising:

a generally cylindrically shaped jacket having a generally conical tip, a body, and a closed base forming an interior, said jacket being formed of copper;

an elongated generally cylindrically shaped penetrant having a generally conical tip, a body, and a base, said penetrant being located within said jacket with said penetrant tip being adjacent said jacket tip and said penetrant base being vertically spaced from said jacket base, said penetrant being formed of an alloy including powdered tungsten and powdered bismuth compressed into a solid; and, a core formed of an alloy including powdered tungsten and powdered bismuth and at least one of powdered tin and powdered copper compressed into a solid, said core filling said jacket interior encasing at least said penetrant body and penetrant base.

* * * * *